US005839933A

United States Patent [19]

Davis, Sr. et al.

[11] Patent Number: 5,839,933

[45] Date of Patent: Nov. 24, 1998

[54] INFLATABLE LIFE VEST

[76] Inventors: Claude D. Davis, Sr.; Douglas M. Edsall, both of 315 Holly Manor Rd., Catonsville, Md. 21228

[21] Appl. No.: 911,561

[22] Filed: Aug. 14, 1997

[51] Int. Cl.[6] ..... B63C 9/19

[52] U.S. Cl. ..... 441/94; 441/116

[58] Field of Search ..... 441/90, 91, 92, 441/93, 94, 114, 115, 116, 117, 118

[56] References Cited

U.S. PATENT DOCUMENTS

| | | | |
|---|---|---|---|
| 3,910,457 | 10/1975 | Sutliff et al. | 441/94 |
| 4,097,947 | 7/1978 | Kiefer | 441/116 |
| 4,242,769 | 1/1981 | Rayfield et al. | 441/91 |
| 4,416,641 | 11/1983 | Spinosa et al. | 441/116 |
| 4,524,885 | 6/1985 | Zimmerly | 441/94 |
| 4,927,057 | 5/1990 | Janko et al. | 441/93 |
| 5,074,765 | 12/1991 | Pekar | 41/91 |
| 5,338,239 | 8/1994 | Cleaveland | 441/106 |
| 5,603,646 | 2/1997 | Tobias | 441/94 |

*Primary Examiner*—Sherman Basinger

[57] ABSTRACT

An inflatable life vest is provided including a vest and an inflatable bladder situated therein. Next provided is an air actuation mechanism comprising a mounting assembly which includes a threaded opening in communication with the inflatable bladder. In use, the threaded opening is equipped for releasably receiving a cylindrical pressurized air canister. A valve is slidably situated above the threaded opening with a pin coupled to a bottom surface thereof. A spring is situated between the valve and the threaded opening. The valve has a first unbiased orientation wherein the pin sits distant the threaded opening and a second biased orientation wherein the pin resides within the threaded opening for effecting the release of air from the pressurized air canister. The mounting assembly further includes a lever pivotally attached to the mounting assembly and adapted to transfer the valve to the second biased orientation upon the pivoting thereof. Further provided is an automatic and manual air actuator which are both adapted to effect the pivoting of the lever.

8 Claims, 2 Drawing Sheets

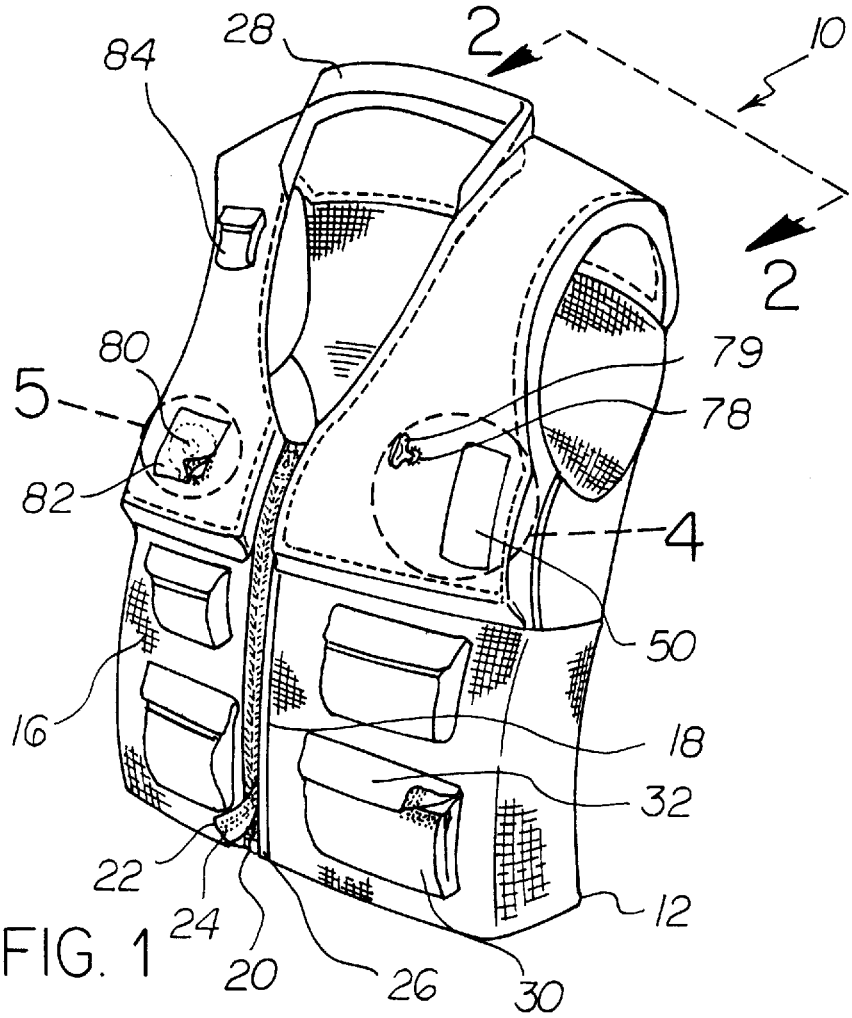
FIG. 1
FIG. 2
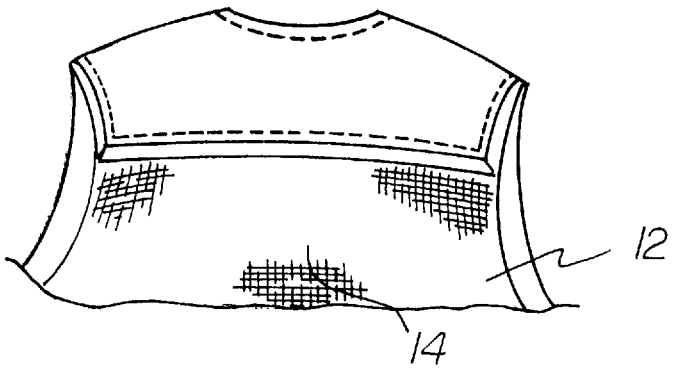

INFLATABLE LIFE VEST

BACKGROUND OF THE INVENTION

1. Field of the Invention

The present invention relates to life vests and more particularly pertains to a new inflatable life vest for allowing both the automatic and manual inflation of a bladder within a life vest.

2. Description of the Prior Art

The use of life vests is known in the prior art. More specifically, life vests heretofore devised and utilized are known to consist basically of familiar, expected and obvious structural configurations, notwithstanding the myriad of designs encompassed by the crowded prior art which have been developed for the fulfillment of countless objectives and requirements.

Known prior art life vests include U.S. Pat. No. 5,338,239; U.S. Pat. No. 5,035,345; U.S. Pat. No. 4,246,672; U.S. Pat. Des. 361,115; U.S. Pat. No. 4,681,552; and U.S. Pat. No. 5,311,394.

In these respects, the inflatable life vest according to the present invention substantially departs from the conventional concepts and designs of the prior art, and in so doing provides an apparatus primarily developed for the purpose of allowing both the automatic and manual inflation of a bladder within a life vest.

SUMMARY OF THE INVENTION

In view of the foregoing disadvantages inherent in the known types of life vests now present in the prior art, the present invention provides a new inflatable life vest construction wherein the same can be utilized for allowing both the automatic and manual inflation of a bladder within a life vest.

The general purpose of the present invention , which will be described subsequently in greater detail, is to provide a new inflatable life vest apparatus and method which has many of the advantages of the life vests mentioned heretofore and many novel features that result in a new inflatable life vest which is not anticipated, rendered obvious, suggested, or even implied by any of the prior art life vests, either alone or in any combination thereof.

To attain this, the present invention generally comprises a vest constructed from a polyester mesh material. As shown in FIG. 1, the vest includes a rear portion and a front portion halved by a central slit. The slit has a zipper formed thereon for allowing the selective coupling of the halves of the front portion. A lip is coupled along the central slit adjacent the zipper with a pile fastener mounted thereon. Such pile fastener serves to releasably couple to another pile fastener mounted on an opposite half of the front portion of the vest adjacent the central slit. As an option, the vest may further include a collar extending upwardly from a rear portion of a neck opening formed in the vest. Next provided is a plurality of cargo pockets coupled to a lower extent of both halves of the front portion of the vest. Each pocket has a lid coupled along a top edge thereof with a pile fastener situated thereon. Such pile fastener is adapted for releasably coupling with another pile fastener situated on a front face of the pocket thereby allowing the selective sealing of the pocket. With reference now to FIG. 3, it can be seen that an inflatable bladder is provided. The bladder has a rear portion with a generally rectangular configuration and a pair of front portions each with a generally square configuration. The front portions are coupled along rear edges thereof to the rear portion thereby defining a neck aperture. A top surface of the bladder is equipped with pile fasteners coupled thereto for releasably coupling with a plurality of pile fasteners positioned on an interior of the vest. It should be noted that the front and rear portions of the bladder reside in an upper half of the vest. Also included is an air actuation mechanism with a mounting assembly attached to the top surface of one of the front portions of the inflatable bladder and situated within the vest. The mounting assembly includes a threaded opening in communication with the inflatable bladder thereby equipped for releasably receiving a cylindrical pressurized air canister. Note FIG. 4. A valve is slidably situated above the threaded opening with a pin coupled to a bottom surface thereof. Associated therewith is a spring situated between the valve and the threaded opening. During operation, the valve has a first unbiased orientation wherein the pin sits distant the threaded opening. The valve further has a second biased orientation wherein the pin resides within the threaded opening for effecting the release of air from the pressurized air canister. For controlling the orientation of the valve, the mounting assembly further includes a lever pivotally attached to the mounting assembly and adapted to transfer the valve to the second biased orientation upon the pivoting thereof. Next provided is an automatic air actuator including a motor coupled to the mounting assembly. Eccentrically coupled to the motor is an interconnection member having an end attached to the lever. The motor is adapted to pivot the lever of the mounting assembly upon the actuation thereof. The automatic air actuator further includes a water switch adapted to actuate the motor upon the detection of water. Also included is a manual air actuator having a pull cord with a first end coupled to the lever of the mounting assembly and a second end extending through an aperture formed in the vest. A T-shaped handle is coupled to the second end of the pull cord. By this structure, the pull cord is adapted to pivot the lever of the mounting assembly upon the pulling thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new inflatable life vest apparatus and method which has many of the advantages of the life vests mentioned heretofore and many novel features that result in a new inflatable life vest which is not anticipated, rendered obvious, suggested, or even implied by any of the prior art life vests, either alone or in any combination thereof.

It is another object of the present invention to provide a new inflatable life vest which may be easily and efficiently manufactured and marketed.

It is a further object of the present invention to provide a new inflatable life vest which is of a durable and reliable construction.

An even further object of the present invention is to provide a new inflatable life vest which is susceptible of a low cost of manufacture with regard to both materials and labor, and which accordingly is then susceptible of low prices of sale to the consuming public, thereby making such inflatable life vest economically available to the buying public.

Still yet another object of the present invention is to provide a new inflatable life vest which provides in the apparatuses and methods of the prior art some of the advantages thereof, while simultaneously overcoming some of the disadvantages normally associated therewith.

Still another object of the present invention is to provide a new inflatable life vest for allowing both the automatic and manual inflation of a bladder within a life vest.

Yet another object of the present invention is to provide a new inflatable life vest which includes allowing both the automatic and manual inflation of a bladder within a life vest.

Even still another object of the present invention is to provide a new inflatable life vest that includes a vest and an inflatable bladder situated therein. Next provided is an air actuation mechanism comprising a mounting assembly which includes a threaded opening in communication with the inflatable bladder. In use, the threaded opening is equipped for releasably receiving a cylindrical pressurized air canister. A valve is slidably situated above the threaded opening with a pin coupled to a bottom surface thereof. A spring is situated between the valve and the threaded opening. The valve has a first unbiased orientation wherein the pin sits distant the threaded opening and a second biased orientation wherein the pin resides within the threaded opening for effecting the release of air from the pressurized air canister. The mounting assembly further includes a lever pivotally attached to the mounting assembly and adapted to transfer the valve to the second biased orientation upon the pivoting thereof. Further provided is an automatic and manual air actuator which are both adapted to effect the pivoting of the lever.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new inflatable life vest according to the present invention.

FIG. 2 is a rear view of the vest of the present invention.

DESCRIPTION OF THE PREFERRED EMBODIMENT

Figure 3:
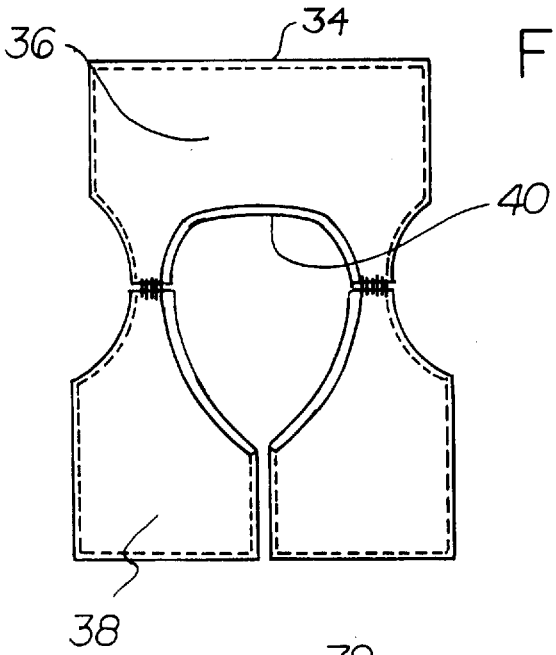
FIG. 3 is a top view of the inflatable bladder of the present invention.
Figure 4:
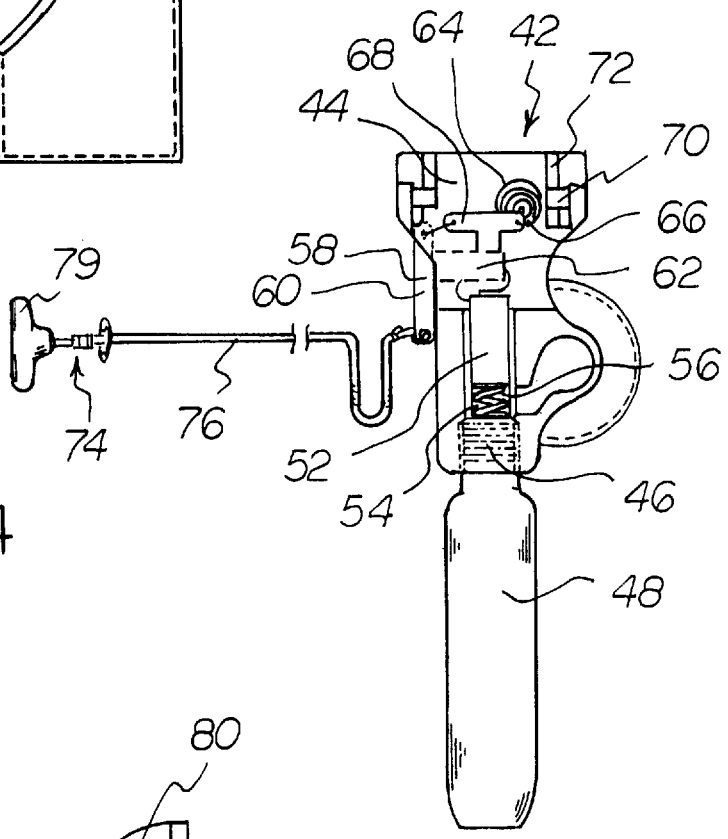
FIG. 4 is a front view of the air actuation mechanism of the present invention.
Figure 5:
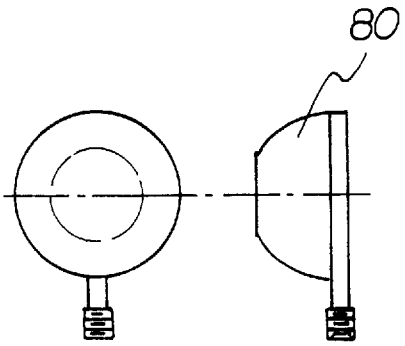
FIG. 5 is a side view of the manual pump mechanism of the present invention.

With reference now to the drawings, and in particular to FIGS. 1 through 5 thereof, a new inflatable life vest embodying the principles and concepts of the present invention and generally designated by the reference numeral 10 will be described.

The system designated as numeral 10 includes a vest 12 constructed from a polyester mesh material. As shown in FIG. 1, the vest includes a rear portion 14 and a front portion 16 halved by a central slit 18. The slit has a zipper 20 formed thereon for allowing the selective coupling of the halves of the front portion. A lip 22 is coupled along the central slit adjacent the zipper with a pile fastener 24 mounted thereon. Such pile fastener serves to releasably couple over the zipper to another pile fastener 26 mounted on an opposite half of the front portion of the vest adjacent the central slit. As an option, the vest may further include a short collar 28 extending upwardly from a rear portion of a neck opening formed in the vest.

Next provided is a plurality of cargo pockets 30 coupled to a lower extent of both halves of the front portion of the vest. Each pocket has a lid 32 coupled along a top edge thereof with a pile fastener situated thereon. Such pile fastener is adapted for releasably coupling with another pile fastener situated on a front face of the pocket thereby allowing the selective sealing of the pocket. In the preferred embodiment, each half of the front portion is equipped with a two vertically aligned pockets.

With reference now to FIG. 3, it can be seen that an inflatable bladder 34 is provided. The bladder has a rear portion 36 with a generally rectangular configuration and a pair of front portions 38 each with a generally square configuration. The front portions are coupled along rear edges thereof to the rear portion thereby defining a neck aperture 40. A top surface of the bladder is equipped with pile fasteners coupled thereto for releasably coupling with a plurality of pile fasteners positioned on an interior of the vest. Preferably, the pile fasteners line the neck opening associated with the bladder. It should be noted that the front and rear portions of the bladder only reside in an upper half of the vest during use. Note FIG. 1. Preferably, such upper half of the vest is constructed with excess material to form a raised surface for preventing pressure from being applied to a body of user upon the inflation of the bladder.

Also included is an air actuation mechanism 42 with a mounting assembly 44 attached to the top surface of one of the front portions of the inflatable bladder and situated within the vest. The mounting assembly includes a vertically orientated threaded opening 46 in communication with the inflatable bladder. The threaded opening is thereby equipped for releasably receiving a cylindrical pressurized carbon dioxide canister 48. Note FIG. 4. When attached to the threaded opening, access may be gained to the canister by way of a flap 50. Further, the bladder is preferably reinforced at the point of coupling with the mounting assembly.

A valve 52 is slidably situated above the threaded opening within a cylindrical channel 54. The valve is further equipped with a pin 54 coupled to a bottom surface thereof. Associated therewith is a spring 56 situated between the valve and the threaded opening. During operation, the valve has a first unbiased orientation wherein the pin sits distant the threaded opening. The valve further has a second biased orientation wherein the pin resides within the threaded opening for effecting the release of air from the pressurized air canister.

For controlling the orientation of the valve, a T-shaped lever 58 is pivotally attached at a central extent thereof to the mounting assembly. As such, the lever is defined by a vertical member 60 integrally coupled to a horizontal member 62. An outboard end of the horizontal member abuts a top surface of the valve. During use, the lever functions to transfer the valve to the second biased orientation upon the pivoting thereof.

Next provided is an automatic air actuator 64 including a motor 66 coupled to the mounting assembly. Eccentrically coupled to a rotor of the motor is an interconnection member 68 having an end attached to the lever. The interconnection member slidably abuts the top surface of the horizontal member of the T-shaped lever. The motor is adapted to pivot the lever of the mounting assembly upon the actuation thereof. The automatic air actuator further includes a water switch 70 adapted to actuate the motor upon the detection of water. To prevent the inadvertent actuation of the motor, the water switch is preferably situated at the end of a small tube 72. As such, the water switch will only close when the vest is completely submerged.

Also included is a manual air actuator 74 having a pull cord 76 with a first end coupled to a second end of the vertical member of the lever of the mounting assembly and a second end extending through an aperture 78 formed in the vest. A T-shaped handle 79 is coupled to the second end of the pull cord. By this structure, the pull cord is adapted to pivot the lever of the mounting assembly when pulled. Situated at the base of the handle is a safety pin coupled through apertures formed both in the vest and handle to prevent the inadvertent actuation of the present invention.

Finally, a manual pump 80 is included having a hemispherical shape with a planar surface mounted to one of the front portions of the inflatable bladder on a half of the front portion of vest opposite the air actuation mechanism. The manual pump serves to inflate the bladder upon the repeated depression thereof. It should be that a flap 82 is positioned over the manual pump, as shown in FIG. 1. As an option, an EPIB 84 may be mounted adjacent the manual hand pump.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An inflatable life vest comprising, in combination:

a vest constructed from a polyester mesh material and including a rear portion and a front portion halved by a central slit, the slit having a zipper formed thereon for allowing the selective coupling of the halves of the front portion with a lip coupled along the central slit adjacent the zipper with a pile fastener mounted thereon for releasably coupling to another pile fastener mounted on an opposite half of the front portion of the vest adjacent the central slit, the vest further comprising a collar extending upwardly from a rear portion of a neck opening formed in the vest;

a plurality of cargo pockets coupled to a lower extent of both halves of the front portion of the vest, each pocket having a lid coupled along a top edge thereof with a pile fastener situated thereon for releasably coupling with another pile fastener situated on a front face of the pocket;

an inflatable bladder comprising a rear portion with a generally rectangular configuration and a pair of front portions each with a generally square configuration, the front portions coupled along rear edges thereof to the rear portion thereby defining a neck aperture, a top surface of the bladder having pile fasteners coupled thereto for releasably coupling with a plurality of pile fasteners positioned on an interior of the vest, wherein the front and rear portions of the bladder reside in an upper half of the vest;

an air actuation mechanism including a mounting assembly attached to the top surface of one of the front portions of the inflatable bladder and situated within the vest, the mounting assembly including a threaded opening in communication with the inflatable bladder thereby equipped for releasably receiving a cylindrical pressurized air canister, a valve slidably situated above the threaded opening with a pin coupled to a bottom surface thereof and a spring situated between the valve and the threaded opening, the valve having a first unbiased orientation wherein the pin sits distant the threaded opening and a second biased orientation wherein the pin resides within the threaded opening for effecting the release of air from the pressurized air canister, the mounting assembly further including a lever pivotally attached to the mounting assembly and adapted to transfer the valve to the second biased orientation upon the pivoting thereof;

an automatic air actuator including a motor coupled to the mounting assembly and an interconnection member having a first end eccentrically coupled to the motor and a second end attached to the lever, the motor adapted to pivot the lever of the mounting assembly upon the actuation thereof, the automatic air actuator further including a water switch adapted to actuate the motor upon the detection of water;

a manual air actuator including a pull cord having a first end coupled to the lever of the mounting assembly and a second end extending through an aperture formed in the vest with a handle coupled thereto, whereby the pull cord is adapted to pivot the lever of the mounting assembly upon the pulling thereof; and a manual pump having a hemispherical configuration with a planar surface mounted to one of the front portions of the inflatable bladder on a half of the front portion of the vest the manual pump adapted for inflating the bladder upon the repeated depression thereof.

2. An inflatable life vest comprising:

a vest;

an inflatable bladder situated within the vest;

an air actuation mechanism including a mounting assembly attached to a top surface of a front portion of the inflatable bladder and situated within the vest, the mounting assembly including a threaded opening in communication with the inflatable bladder for releasably receiving a cylindrical pressurized air canister and a valve slidably situated above the threaded opening with a pin coupled to a bottom surface thereof and a spring situated between the valve and the threaded opening, the valve having a first unbiased orientation wherein the pin sits distant the threaded opening and a second biased orientation wherein the pin resides within the threaded opening for effecting the release of air from the pressurized air canister, the mounting assembly further including a lever pivotally attached to the mounting assembly and adapted to transfer the valve to the second biased orientation upon the pivoting thereof;

an automatic air actuator including a rotary motor coupled to the mounting assembly and an interconnection member having a first end eccentrically coupled to the motor and a second end attached to the lever, the motor adapted to pivot the lever of the mounting assembly upon the actuation thereof, the automatic air actuator further including a water switch adapted to actuate the motor upon the detection of water; and a manual air actuator including a pull cord having a first end coupled to the lever of the mounting assembly and a second end with a handle coupled thereto, whereby the pull cord is adapted to pivot the lever of the mounting assembly upon the pulling thereof.

3. An inflatable life vest as set forth in claim 2 and further including a manual pump for inflating the bladder upon the repeated depression thereof.

4. An inflatable life vest as set forth in claim 2 wherein the vest is constructed from a polyester mesh material.

5. An inflatable life vest as set forth in claim 2 wherein the vest includes a rear portion and a front portion halved by a central slit.

6. An inflatable life vest as set forth in claim 5 wherein the slit has a zipper formed thereon for allowing the selective coupling of the halves of the front portion with a lip coupled along the central slit adjacent the zipper with a pile fastener mounted thereon for releasably coupling to another pile fastener mounted on an opposite half of the front portion of the vest adjacent the central slit.

7. An inflatable life vest as set forth in claim 2 wherein the vest includes a collar extending upwardly from a rear portion of a neck opening formed in the vest.

8. An inflatable life vest as set forth in claim 2 wherein the vest includes a plurality of cargo pockets coupled to a lower extent of both halves of the front portion of the vest.

* * * * *